US005535572A

United States Patent [19]

Morantz et al.

[11] Patent Number: 5,535,572

[45] Date of Patent: Jul. 16, 1996

[54] APPARATUS FOR PLACING CORNER PROTECTORS AND TOP PROTECTORS ON PALLETIZED LOADS

[75] Inventors: Jack I. Morantz, Westmount; David T. Lencz, Lasalle; Normand Boyer, St. Michal, all of Canada

[73] Assignee: Illinois Tool Works Inc., Glenview, Ill.

[21] Appl. No.: 173,422

[22] Filed: Dec. 23, 1993

Related U.S. Application Data

[63] Continuation-in-part of Ser. No. 83,518, Jun. 30, 1993, Pat. No. 5,390,476.

[51] Int. Cl.[6] ..... B65B 11/00; B65B 61/00

[52] U.S. Cl. ..... 53/139.7; 53/389.1; 53/588

[58] Field of Search ..... 53/139.6, 139.7, 53/135.2, 588, 156, 157, 540, 176, 207, 580, 377.3, 389.1, 550

[56] References Cited

U.S. PATENT DOCUMENTS

| | | | |
|---|---|---|---|
| 2,714,792 | 8/1955 | Wright et al. | 53/377.3 X |
| 2,937,484 | 5/1960 | Wiman | 53/176 X |
| 3,026,659 | 3/1962 | Harrison | 53/389.1 X |
| 3,378,987 | 4/1968 | Lems | 53/139.7 |
| 3,953,020 | 4/1976 | Ruf et al. | 53/571 X |
| 4,897,980 | 2/1990 | Geyser et al. | 53/128 |
| 4,930,292 | 6/1990 | Focke et al. | 53/550 X |
| 4,947,605 | 8/1990 | Ramsey | 53/550 X |
| 4,949,533 | 8/1990 | Bate | 53/556 |
| 5,044,499 | 9/1991 | Marion | 53/540 X |
| 5,226,280 | 7/1993 | Scherer et al. | 53/139 |

FOREIGN PATENT DOCUMENTS

| | | | |
|---|---|---|---|
| 853775 | 4/1987 | Finland | 53/139.7 |

*Primary Examiner*—Linda Johnson

*Attorney, Agent, or Firm*—Donald J. Breh; Thomas W. Buckman; John P. O'Brien

[57] ABSTRACT

Apparatus for wrapping a load in film material is provided with magazines of vertically oriented corner protectors, each associated with a corner of the load, and from which a corner protector is withdrawn and transferred to cover the corresponding corner of the load prior to wrapping the latter with plastic film material. The magazines comprise a pair of vertically spaced apart conveyor belts which feed the corner protectors to a discharge end of the magazine, and a pick-up and transfer arm pivotal about a single arm axis transfers a corner protector from the magazine through an arc of 135° which aligns the corner protector for movement into engagement with the corner of the load. The apparatus further includes a shuttle mechanism including a pick-up and transfer assembly for moving a top protector from a supply station onto the top of the load, and the pick-up and transfer assembly includes finger plates each of which is pivotal about a corresponding axis to initial bend a marginal edge portion of the top protector downwardly relative to the top edges of the load, and each of which finger plates is horizontally reciprocable to complete the bending of the marginal edge portions against the sides of the load.

40 Claims, 13 Drawing Sheets

FIG. 11G
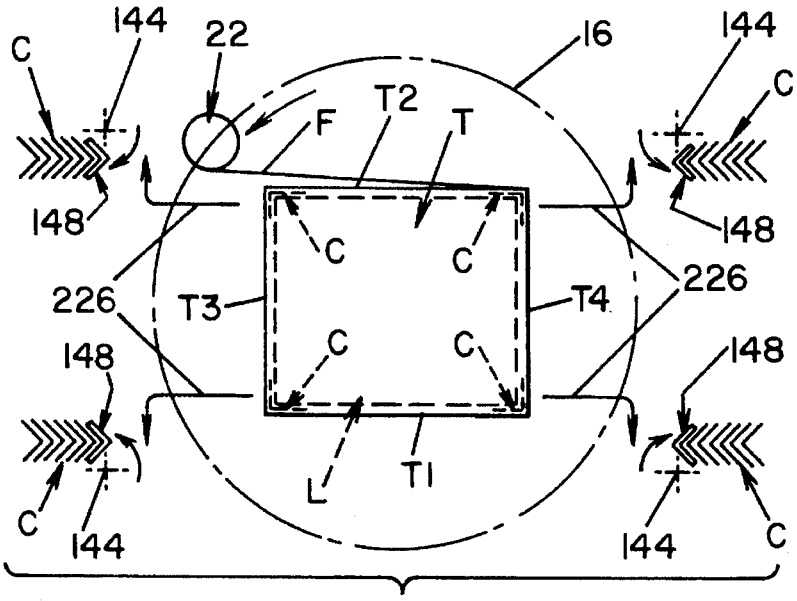
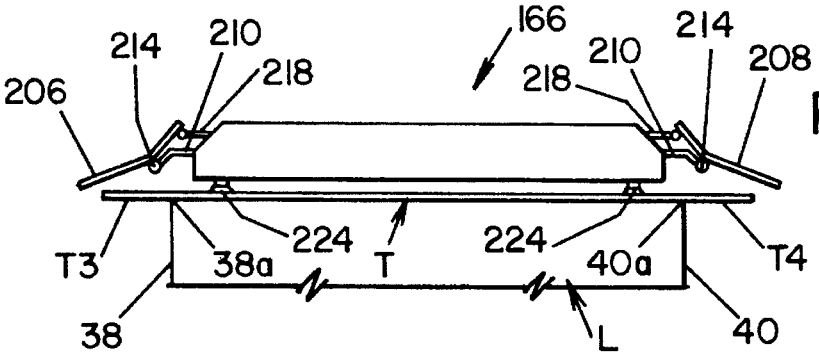
FIG. 12A
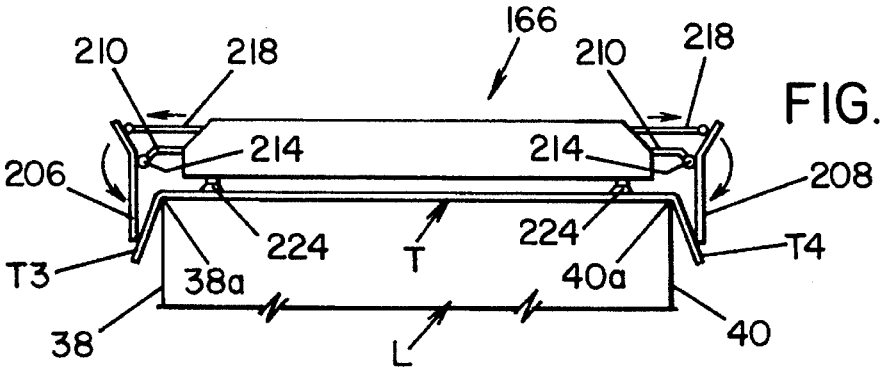
FIG. 12B
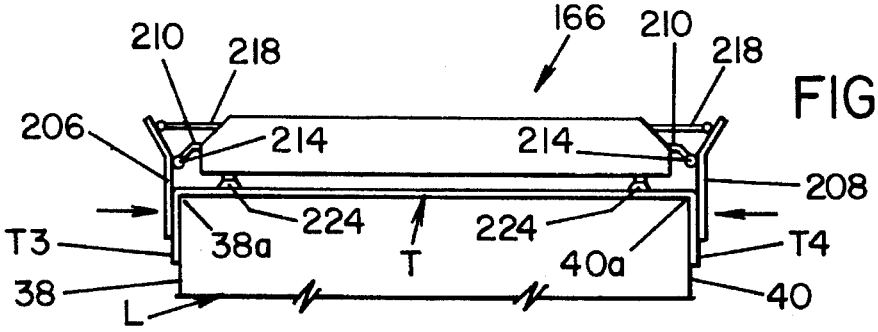
FIG. 12C

APPARATUS FOR PLACING CORNER PROTECTORS AND TOP PROTECTORS ON PALLETIZED LOADS

This application is a continuation-in-part application of Ser. No. 083,518, filed Jun. 30, 1993 now U.S. Pat. No. 5,390,476.

BACKGROUND OF THE INVENTION

The present invention relates in general to the art of apparatus for wrapping or banding palletized loads and, more particularly, to improved apparatus for placing corner protectors and/or top protectors onto a load prior to the wrapping or banding thereof.

The present application is a continuation-in-part of copending application Ser. No. 083,518 filed Jun. 30, 1993 disclosing apparatus for wrapping plastic film material around a stationary article or load, and the disclosure of which application is incorporated by reference herein. The improvements according to the present invention find particular utility in conjunction with apparatus of the character disclosed in the foregoing copending application and, accordingly, will be described herein in conjunction with such apparatus. At the same time, it will be appreciated that the improvements have utility in conjunction with other apparatus for packaging loads in plastic film material as well as apparatus by which loads are banded as opposed to being wrapped in plastic film material.

Load or article wrapping apparatus of the character to which the present invention relates generally comprises a stationary frame for receiving a load to be wrapped, and a rotating and vertically reciprocable film dispensing unit supported on the frame for rotation about the load to wrap the latter in the film. The load to be wrapped may, for example, be comprised of a plurality of square or rectangular articles placed side-by-side and end-to-end in a plurality of vertical layers, whereby the load has opposed pairs of opposite vertical sides, adjacent ones of which sides meet at an angle to provide a vertical corner therebetween. The load also has a top defined by horizontal top edges extending between the vertical corners. Prior to wrapping or banding the load, it is often desirable to apply corner protectors to the corners of the load and/or to apply a top protector to the top of the load so as to protect the vertical corners and top edges of the load from being crushed by the wrapping film or strapping, or being crushed or otherwise damaged during transportation and storage of the wrapped or strapped load.

The corner protectors are generally made from paper or paperboard material pre-folded to provide a pair of panels having inside surfaces meeting at an angle corresponding to that of the corners of the load. Generally, apparatus for applying corner protectors onto a load comprises, for each corner of the load, a magazine arrangement for storing a supply of the corner protectors, and a pick-up and transfer mechanism associated with the magazine for removing a corner protector from the magazine and transferring the protector to the corresponding corner of the load. One such apparatus heretofore proposed for the latter purpose is disclosed in U.S. Pat. No. 5,226,280 to Scherer et al wherein the magazine for the corner protectors is in the form of an inclined chute having an inner discharge end relative to the load and from which the corner protectors are withdrawn and transferred to the load. The corner protectors slide downwardly along the chute toward the discharge end under the influence of gravity and a wheeled feed carriage therebehind. The innermost corner protector is removed from the magazine and transferred to the corresponding load corner by an articulated arm assembly pivotal sequentially about two pivot axes to initially orient the corner protector relative to the corner. Thereafter, portions of the arm assembly are jogged horizontally in directions perpendicular to one another to move the protector into engagement with the corner of the load.

Apparatus of the foregoing character is structurally and operationally complex and, thus, expensive from the standpoint of cost of construction, maintenance and operating time. In this respect, for example, the magazine carriage has to be withdrawn and held at the upper end of the chute during loading thereof with corner protectors and then released to engage behind the outermost one of the corner protectors relative to the discharge end of the chute. Furthermore, while there is a restraint for engaging the innermost corner protector in the chute to preclude more than one corner protector being withdrawn at a time from the magazine, including a finger for engaging the upper end or the innermost corner protector, the mechanism for this purpose is structurally complex and there is a time during removal of a corner protector from the magazine when the finger provides the only restraint and fails to perform its function resulting in one or more of the corner protectors falling outwardly of the discharge end of the magazine. Particularly in this respect, the corner protectors are often recycled and intermixed with other protectors whereby, as the result of damaged ends or such intermixing the magazine is filled with protectors of different lengths. Thus, one or a number of "short" protectors reaching the innermost end of the magazine are not engaged by the finger and fall out of the magazine. Such unintended discharge of one or more of the corner protectors is disruptive with respect to operation of the wrapping or strapping apparatus and, additionally, requires removal of the corner protectors from the area at the discharge end of the magazine and discarding thereof as unusable. Still further, the articulated arm arrangement by which a corner protector is removed from the magazine and transferred to the corresponding corner of the load is likewise structurally complex requiring mechanisms for pivoting one portion of the arm about one axis and the entire arm about a second axis in order to appropriately position the inner sides of the corner protector relative to the corner of the load. This undesirably adds to the expense of the construction of the apparatus as well as to the maintenance and operation thereof.

Top protectors are also made of paper or paperboard material, and top protector applicators heretofore provided generally include a shuttle mechanism carrying a pick-up and transfer assembly by which a flat top protector is picked-up from a supply station and transferred to a position on top of the load. The pick-up and transfer assembly includes fingers by which marginal edge portions of the top protector are bent downwardly to overlie the upper ends of the sides of the load. Heretofore, the fingers by which the marginal edge portions of the top protector are folded downwardly are pivotal about axes parallel to the top edges of the load and laterally or horizontally fixed relative thereto. Accordingly, a different folding finger assembly has to be provided for each load having different top edge dimensions. In this respect, a finger assembly in which the pivot axes are laterally spaced apart a fixed distance cannot be operated to appropriately fold the marginal edge portions of a top protector for a load in which the opposed parallel side edges of the top are spaced apart a distance either greater than or less than the fixed distance between the finger axes. In this respect, if the load edges are spaced apart a distance less than the distance between the finger axes, the fingers cannot pivot to fold the marginal edge portions of the top protector, and if the load edges are spaced apart a distance greater than the distance between the finger axes, the fingers can only partially fold the marginal edge portions downwardly and cannot displace the latter into facial engagement with the sides of the load. Having to provide different finger assemblies for different sized loads is expensive from the standpoint of having to construct a plurality of finger assemblies and from the standpoint of the time required to remove one assembly and replace it with another.

SUMMARY OF THE INVENTION

In accordance with one aspect of the present invention, improved corner protector applying apparatus is provided which minimizes or overcomes the problems encountered with such apparatus heretofore available. More particularly in this respect, corner applying apparatus in accordance with the present invention provides a magazine structure for holding a supply of corner protectors by engaging the opposite ends thereof between corresponding conveyors by which the corner protectors are advanced in the direction toward the discharge end of the magazine. This advantageously stabilizes the corner protectors along the length of the magazine and adjacent the discharge end of the magazine, thus to preclude unintended displacement or the falling out of corner protectors from the discharge end of the magazine in conjunction with removal of the endmost corner protector and transfer of the removed protector to the corner of the load. Furthermore, the conveyor arrangement enables positive displacement of the corner protectors in the direction of discharge with a stabilized orientation of the corner protectors relative to one another and to the conveyors, thus to preclude any unintended relative displacement therebetween during operation of the apparatus.

Each magazine has a pick-up and transfer arm assembly associated with the discharge end thereof for removing the innermost corner protector and transferring the removed protector to a position facing the corresponding corner of the load. The arm mechanism is structurally simple and is pivotal about a single arm axis so as to reorient the corner protector from its position in the magazine to a position in which the panels of the corner protector are parallel to the sides of the load forming the corresponding corner. The magazine and arm assembly are mounted on a carriage for displacement in a direction parallel to one of the corner protector panels, and the arm assembly is displaceable relative to the carriage in the direction parallel to the other corner protector panel, whereby jogging of the carriage and arm assembly quickly moves the corner panel into engagement with the sides of the load forming the corresponding corner. The conveyors are adjustable with respect to the distance therebetween so as to accommodate use of the apparatus with corner protectors of different lengths, and one of the conveyors is pivotal relative to the other about an axis at the discharge end of the magazine to accommodate loading the latter with corner protectors.

In accordance with another aspect of the invention, top protector applying apparatus is provided which advantageously enables the application of top protectors to loads having different top edge dimensions. More particularly in this respect, a top applicator in accordance with the present invention includes a finger assembly in which opposed fingers are pivotal about corresponding axes parallel to the top edges of the load and are horizontally reciprocable to vary the distance between the parallel axes of opposed fingers of the assembly. Accordingly, the finger assembly is operable to fold the marginal edge portions of top protectors for loads having opposite parallel top edges spaced apart by any dimension between the minimum and maximum dimension between the opposed parallel pivot axes of the fingers. This advantageously enables the finger assembly to be used in conjunction with the wrapping or banding of loads having different top edge dimensions without having to change the finger assembly.

It is accordingly an outstanding object of the present invention to provide an improved apparatus for applying corner protectors to a load to be banded or wrapped in plastic film.

Another object is the provision of corner protector applying apparatus in which the opposite ends of a supply of corner protectors are supported in a magazine to stabilize the corner protectors during displacement thereof toward the discharge end of the magazine.

Yet another object is the provision of corner protector applying apparatus of the foregoing character wherein the opposite ends of the corner protectors in the magazine are engaged between conveyors by which the corner protectors are advanced toward the discharge end of the magazine.

Still another object is the provision of corner protector applying apparatus of the foregoing character wherein a corner protector removing and transfer arm assembly is supported adjacent the discharge end of the magazine for removing a corner protector therefrom and pivoting the removed corner protector about a single arm axis to transfer the protector to a position facing the corresponding corner of the load.

A further object is the provision of corner protector applying apparatus of the foregoing character in which the magazine and arm assembly are supported on a carriage reciprocable in one direction relative to the corner of the load and in which the arm assembly is reciprocable relative to the carriage perpendicular to the one direction, whereby jogging of the carriage and arm assembly is operable to position the removed corner protector against the corner of the load.

Another object is the provision of corner protector applying apparatus of the foregoing character which is structurally and operationally simple and economical to construct and maintain.

Still a further object of the invention is the provision of improved top protector applying apparatus for applying a top protector to a load and folding marginal edge portions of the top protector downwardly about the top edges of the load.

Yet a further object is the provision of top protector applying apparatus of the foregoing character which is adapted to apply top protectors to loads having different top edge dimensions.

Yet another object is the provision of top protector applying apparatus of the foregoing character in which folding fingers pivotal about parallel spaced apart axes corresponding to opposed parallel edges of the top of a load are supported for horizontal reciprocation transverse to the pivot axes to vary the space therebetween.

Yet another object of the invention is the provision of a machine for wrapping a load in plastic film with improved apparatus for applying corner protectors and/or a top protector to a load in conjunction with wrapping the load in plastic film material.

BRIEF DESCRIPTION OF THE DRAWINGS

The foregoing objects, and others, will in part be obvious and in part pointed out more fully hereinafter in conjunction with the//written description of preferred embodiments of the invention illustrated in the accompanying drawings in which:

FIGS. 11A–11G schematically illustrate the application of the corner protectors and top protector on a load in the wrapping apparatus and the initial application of plastic wrap thereabout; and FIGS. 12A–12C schematically illustrate the operation of the folding finger assembly in applying a top protector to the top of a load.

DESCRIPTION OF PREFERRED EMBODIMENTS

Figure 1:
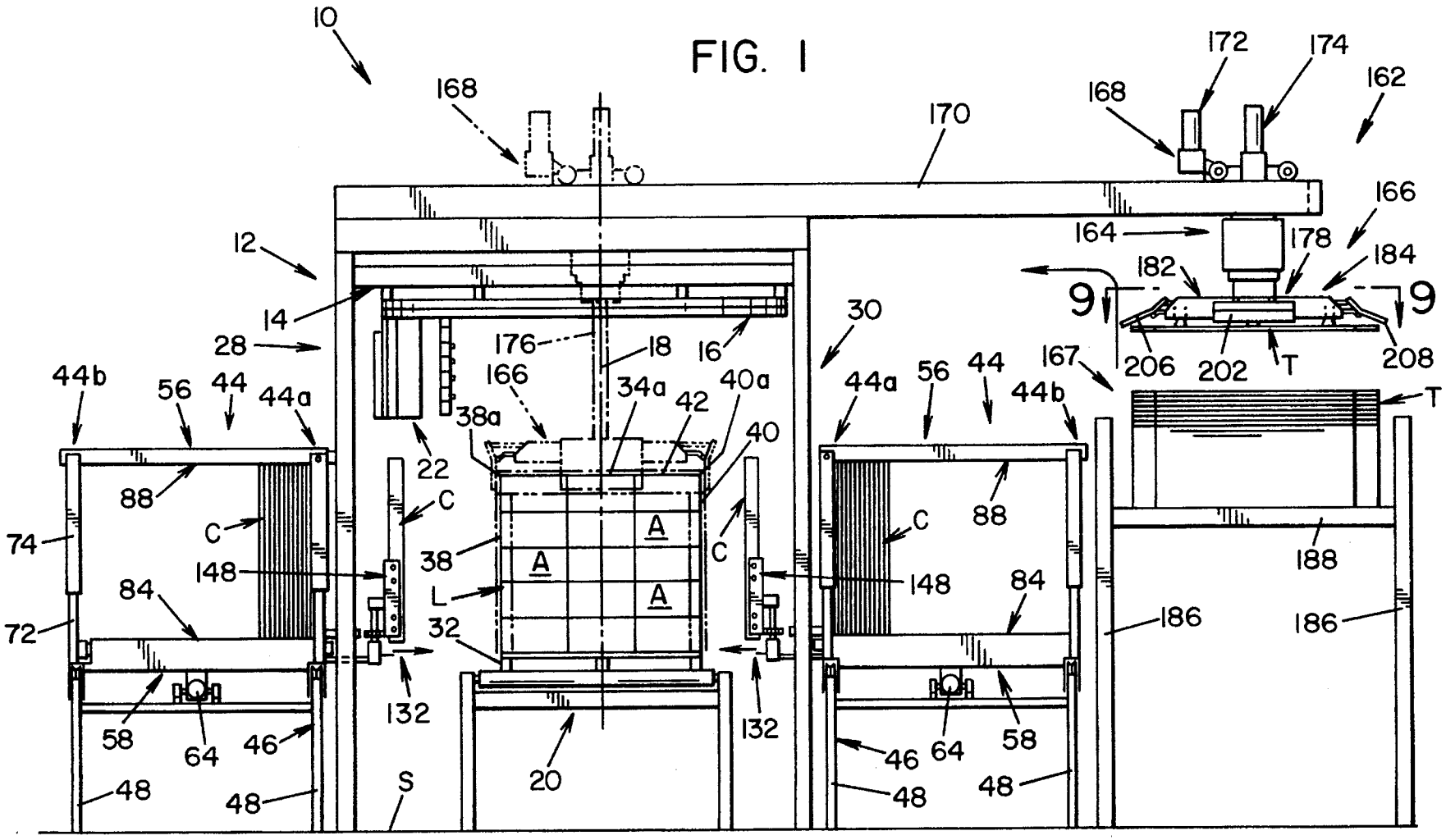
FIG. 1 is an end elevation view of apparatus for wrapping a load in plastic film and having corner protector applying apparatus and top protector applying apparatus in accordance with the invention.
Figure 2:
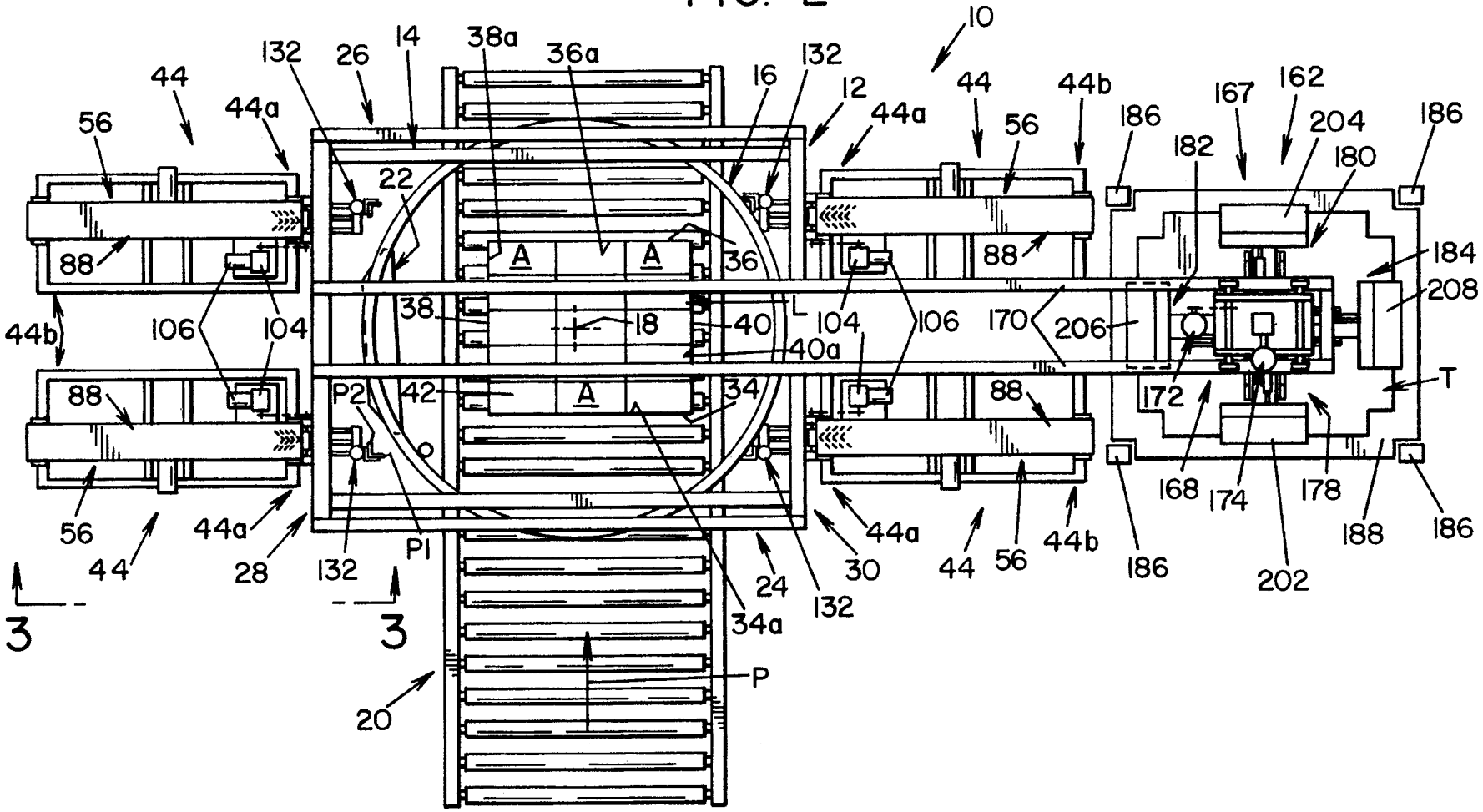
FIG. 2 is a plan view of the wrapping apparatus, corner protecting applying apparatus and top protector applying apparatus shown in FIG. 1.

Referring now in greater detail to the drawings wherein the showings are for the purpose of illustrating preferred embodiments of the invention only and not for the purpose of limiting the invention, FIGS. 1 and 2 illustrate wrapping apparatus 10 comprising a stationary frame assembly 12, a frame assembly 14 supported on frame assembly 12 for vertical displacement relative thereto, and a ring member 16 supported on frame assembly 12 for vertical displacement therewith and for rotation relative thereto about a vertical ring axis 18. Stationary frame assembly 12 is supported on an underlying surface S and spans a conveyor 20 by which a load L to be wrapped in plastic film is moved into a wrapping station position within the apparatus and in which position the load is generally centrally located relative to the perimeter of ring 16. Conveyor 20 may, for example, be a roller conveyor in which the rolls are driven to move load L along a path in the direction of arrow P to the wrapping station and, following wrapping, from the wrapping station to the discharge end of the conveyor. A film carriage assembly 22 is mounted on ring member 16 for displacement therewith and includes a roll of plastic film material, not shown, from which film material is paid out during operation of apparatus to wrap load L. Further, as is well known, a film clamping and sealing assembly, not shown, is mounted on frame assembly 14 for displacement therewith and relative thereto and, as is also well known, such clamping and sealing assembly is operable during wrapping to cause the film material to be paid out from the roll and to sever and seal the film material after the wrapping operation is completed. Beyond providing an understanding of the present invention in conjunction with film wrapping of a load, details concerning the structure and operation of the wrapping apparatus are not necessary, and further details in this respect are disclosed in the aforementioned copending patent application.

With respect to the direction of path P, stationary frame assembly 12 has longitudinally opposite ends 24 and 26 and laterally opposite sides 28 and 30. In the embodiment illustrated, load L is comprised of a plurality of vertically stacked layers of articles A supported on a pallet 32 and which articles, together, provide load L with longitudinally opposite vertical sides 34 and 36 and laterally opposite vertical sides 38 and 40. Adjacent ones of the sides of load L meet generally at right angles to provide the load with four corners, not designated numerically. Load L further includes a top surface 42 having a rectangular periphery defined by longitudinally opposite parallel top edges 34*a* and 36*a* respectively provided by the upper edges of sides 34 and 36, and laterally opposite parallel top edges 38*a* and 40*a* respectively provided by the upper edges of walls 38 and 40 of the load.

In accordance with one aspect of the present invention, corner protector applicator apparatus 44 is provided for positioning a corner protector on each corner of load L prior to the wrapping of plastic film thereabout. The corner protector applying apparatus are basically of the same structure and operation, whereby it will be appreciated that the following description of one of the apparatus shown in FIGS. 3–6 of the drawing is applicable to the others. With reference to the latter Figures, together with FIGS. 1 and 2, each of the apparatus 44 is associated with one of the corners of load L, is positioned laterally outwardly thereof and has corresponding longitudinally spaced apart inner and outer ends 44*a* and 44*b* which provide for each of the apparatus to have an orientation transverse to path P. Each of the apparatus includes a lower, stationary frame assembly 46 comprising vertical corner posts 48, longitudinally extending side members 50 therebetween, laterally extending carriage rail members 52 respectively between posts 48 at the inner end of the apparatus and posts 48 at the outer end thereof, and a pair of longitudinally spaced apart laterally extending frame members 54 between side members 50 intermediate carriage rail members 52.

Frame assembly 46 supports a magazine unit 56 by which a supply of corner protectors C are held and moved in the direction from outer end 44*b* towards inner end 44*a* of the apparatus for pick-up and transfer to the corresponding load corner as will be described in detail hereinafter. Magazine unit 56 is mounted on a carriage assembly 58 comprising a carriage support plate member 59 extending between the inner and outer ends of the apparatus and provided at each of the latter ends with a carriage wheel unit 60 comprising pairs of upper and lower wheels 62 in rolling engagement with the corresponding carriage rail 52. The carriage is adapted to be reciprocated laterally of frame assembly 46 by a motor and gear box unit mounted on the underside of carriage plate 59 and including a motor 64 and a gear box 66 for driving pinions 68 which are in meshing engagement with toothed racks 70 on frame members 54.

Figure 6:
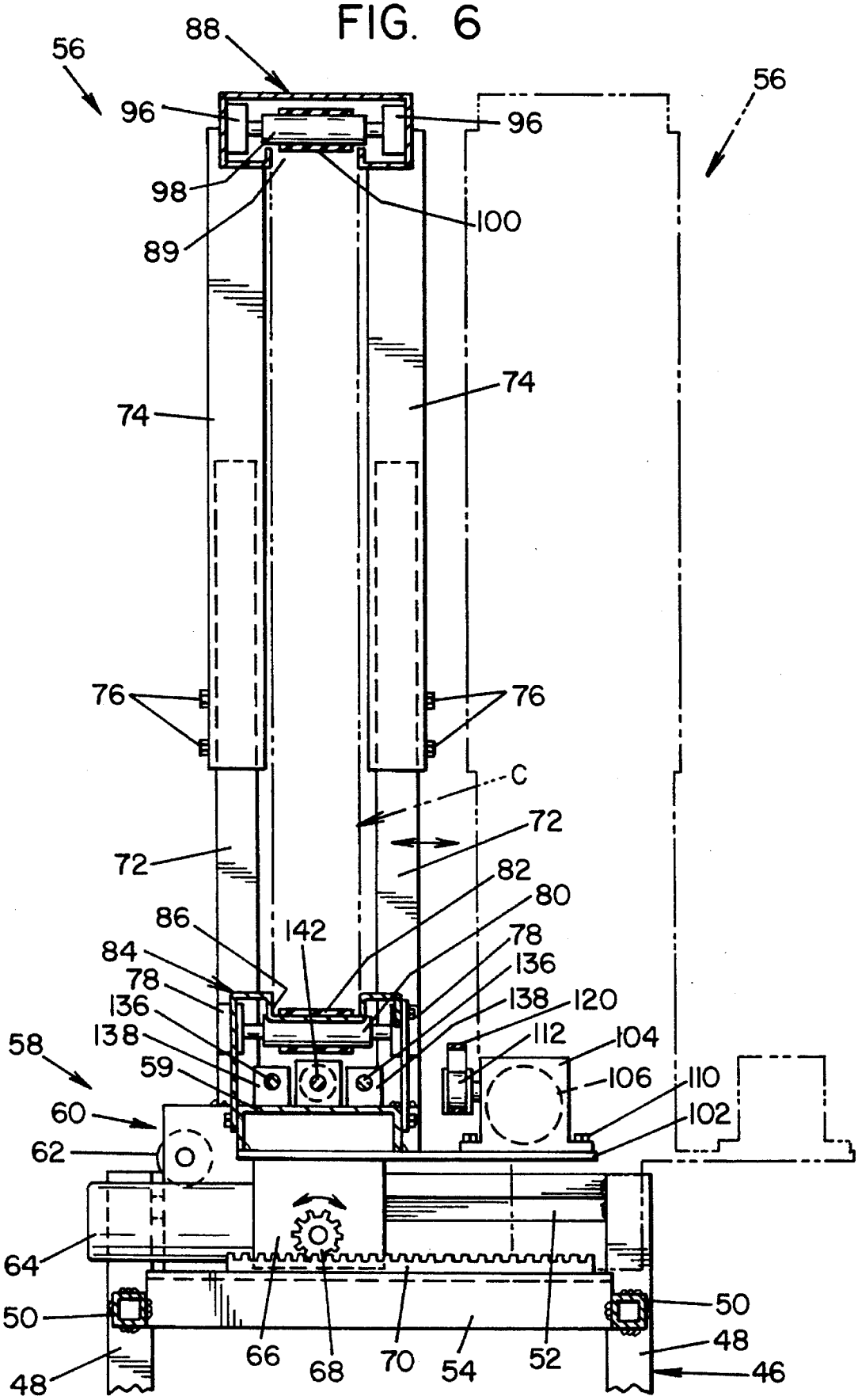
FIG. 6 is an elevation view, in section, of the corner protector applying apparatus taken along line 6—6 in FIG. 3.

Magazine unit 56 further includes vertically adjustable corner posts comprising lower post members 72 welded or otherwise secured to carriage plate member 59 and corresponding upper post members 74 telescopically receiving the upper ends of post members 72. The corresponding post members are secured together such as by means of threaded studs 76, and the ends of post members 72 received in post members 74 are provided with a plurality of openings, not shown, which are vertically spaced apart therealong to provide for adjusting the vertical height of the corner posts relative to carriage plate 59. The lower ends of the lower post members 72 at the the inner and outer ends of carriage plate 59 are provided with support blocks 78 which rotatably support a corresponding conveyor belt roll 80, and a lower endless conveyor belt 82 is trained about rolls 80. As best seen in FIG. 6, a lower conveyor support plate member 84 is attached to the laterally opposite sides of carriage plate 59 and includes an upwardly open channel 86 in the top side thereof which includes a bottom wall, not designated numerically, underlying and supporting the upper run of lower conveyor belt 82.

Figure 3:
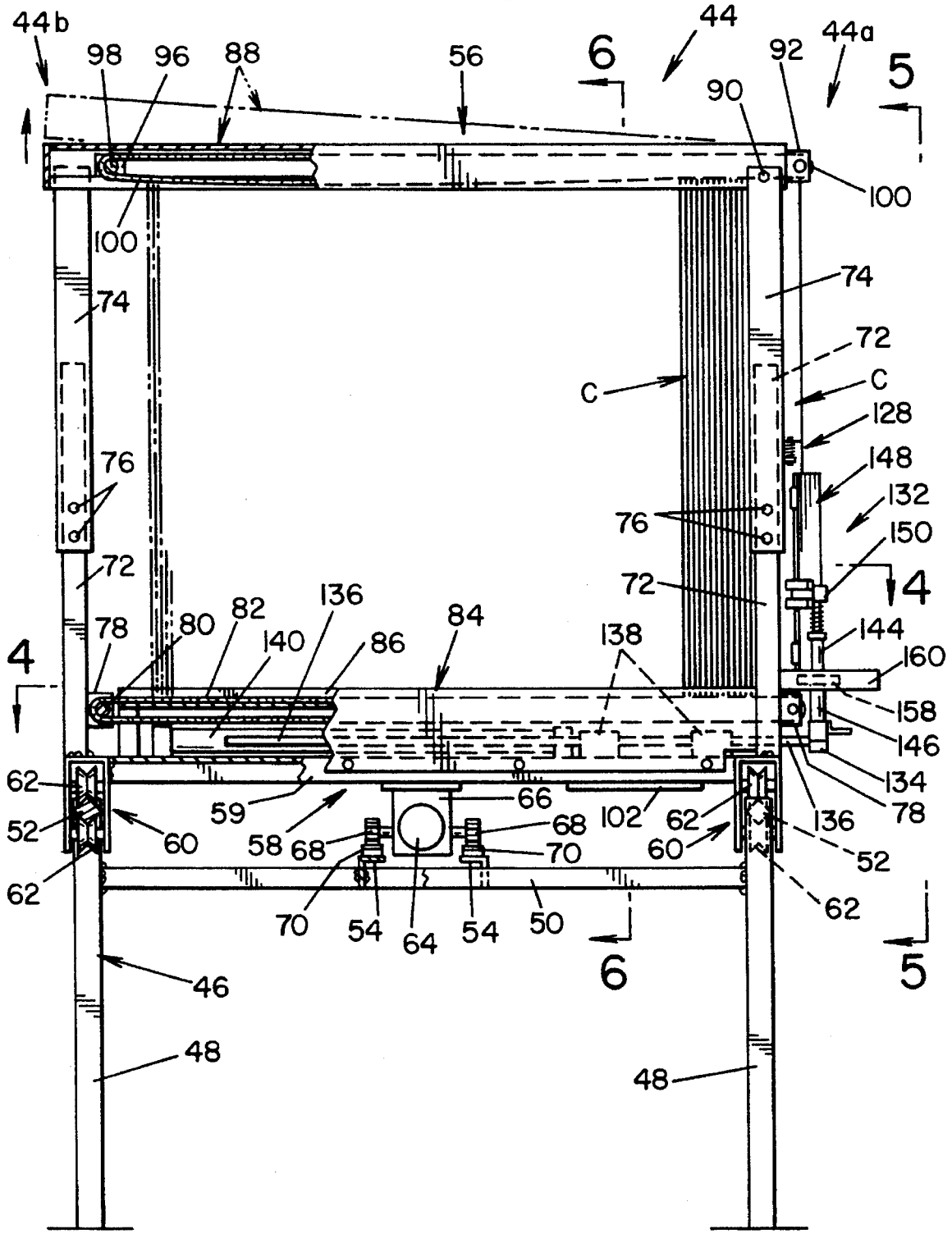
FIG. 3 is a side elevation view, partially in section, taken along line 3—3 in FIG. 2, and showing one of the corner protecting applying apparatus in accordance with the invention.
Figure 5:
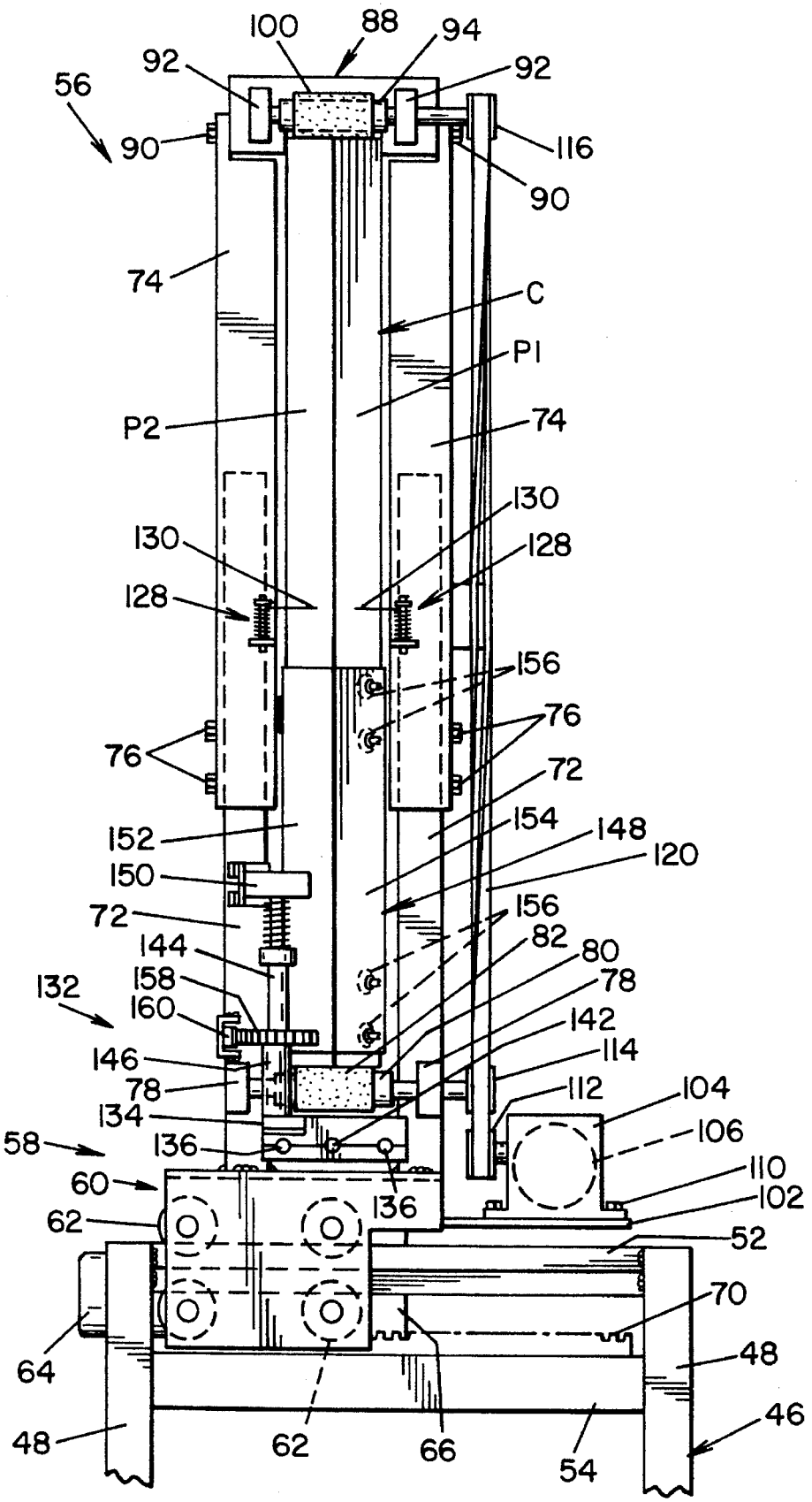
FIG. 5 is an end elevation view of the corner protector applying apparatus looking in the direction of line 5—5 in FIG. 3.

As best seen in FIGS. 3 and 6, the upper end of magazine unit 56 is defined by a pivotal upper conveyor belt assembly including a downwardly open belt support channel member 88 providing a downwardly open channel 89 extending between the inner and outer corner post members 74. For the purpose set forth hereinafter, channel member 88 is pivotally secured to post members 74 at the inner or discharge end of the magazine unit such as by pivot pin members 90 extending through the upper ends of post members 74 and the corresponding side of channel member 88. Pivotal displacement of channel member 88 counterclockwise in FIG. 3 is limited by engagement thereof with the upper ends of corner post members 74 at the outer end of the magazine unit. As best seen in FIG. 5, the inner end of channel member 88 is provided with support blocks 92 rotatably supporting a corresponding conveyor belt roll 94 and, as best seen in FIG. 6, the outer end of channel member 88 is provided on the inner side thereof with support members 96 which rotatably support a corresponding conveyor belt roll 98. An endless conveyor belt 100 is trained about rolls 94 and 98, and it will be noted that the lower run of belt 100 is unsupported and thus free to sag vertically downwardly for the purpose set forth hereinafter. It will also be appreciated that upper conveyor belt 100 is pivotal with channel member 88 about pivot pins 90.

Figure 7:
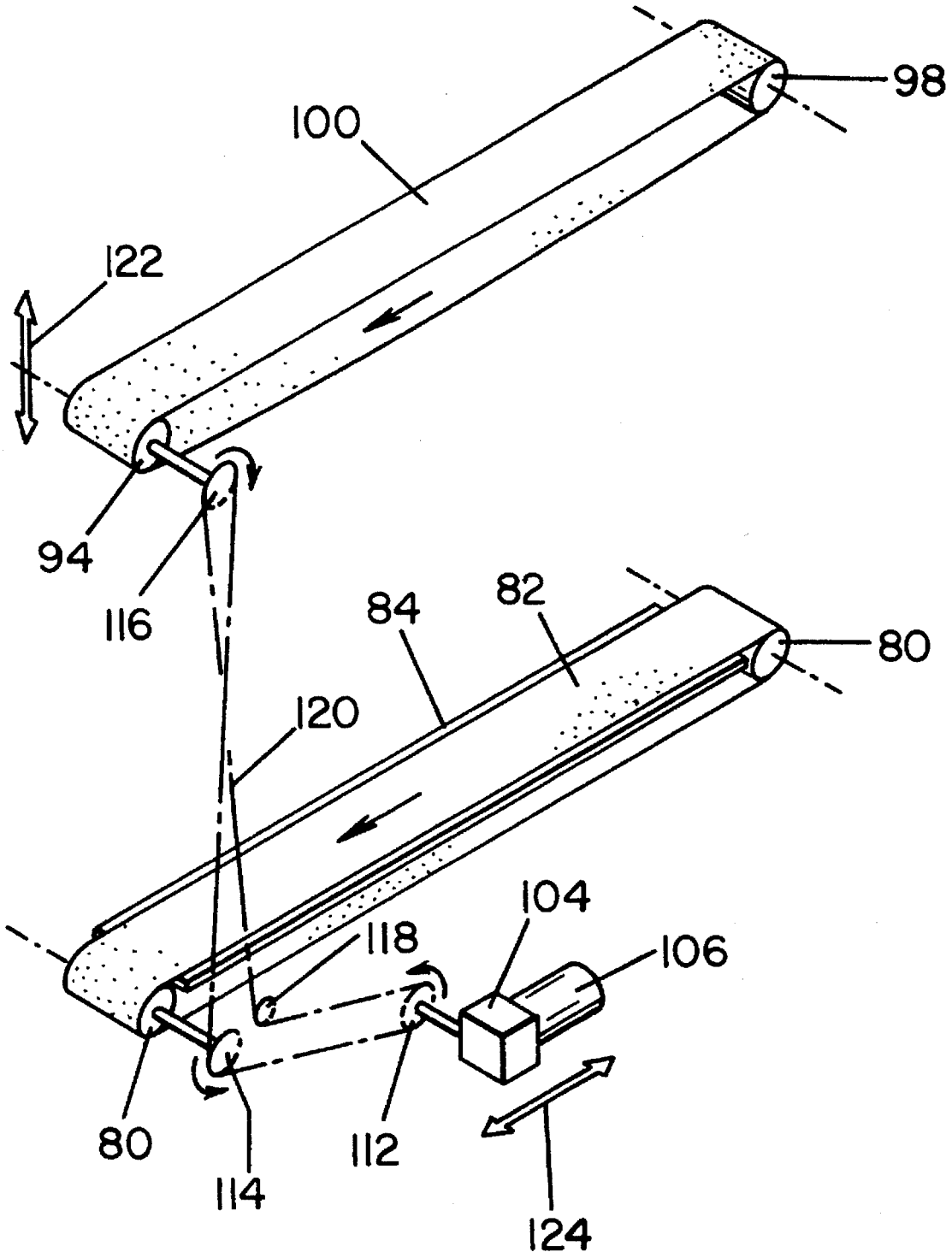
FIG. 7 is a schematic illustration of the conveyor belt drive arrangement for the magazine of the corner protector applying apparatus.

Conveyor belts 82 and 100 are adapted to be driven in unison and in the same direction and, for this purpose, carriage plate 59 is provided laterally outwardly adjacent the inner end thereof with a drive unit support plate 102 which carries a drive unit comprising a gear box 104 and a drive motor 106. For the purpose set forth hereinafter, the drive unit is mounted on plate 102 for longitudinal adjustment and, in this respect, plate 102 is provided with longitudinally extending slots 108 receiving mounting studs 110 extending through openings therefor in mounting flanges on gear box 104, not designated numerically. Gear box 104 drives an output pulley 112, and conveyor rolls 80 and 94 at the inner end of the magazine include drive shafts extending laterally outwardly thereof and having corresponding pulleys 114 and 116 thereon, respectively. An idler pulley is mounted on the laterally outer side of corner post member 72 generally behind pulley 114 of conveyor roll 80 and, as will be best appreciated from FIG. 7, a drive belt 120 drivingly interconnects belt pulleys 114 and 116 with drive unit output pulley 112 through idler pulley 118. As will be further appreciated from the latter Figure, the runs of belt 120 extending from lower belt pulley 114 and idler pulley 118 to upper belt pulley 116 cross one another, whereby belt 120 is adapted to drive the vertically opposed runs of conveyor belts 82 and 100 in unison and in the same direction. The vertical adjustment capability with respect to corner posts 72 and 74 provides for adjusting the vertical position of conveyor 100 relative to conveyor 82 and, with further regard to FIG. 7, and in conjunction with such vertical adjustment of conveyor 100, the longitudinal adjustment of the drive unit for the conveyor belts accommodates such vertical adjustment. More particularly, the conveyor and drive unit, adjustments are respectively indicated by arrows 122 and 124 in FIG. 7, it will be appreciated that the vertical adjustment of the space between conveyor belts 82 and 100 is readily accommodated by horizontally adjusting the position of the drive unit the belt 120.

Figure 4:
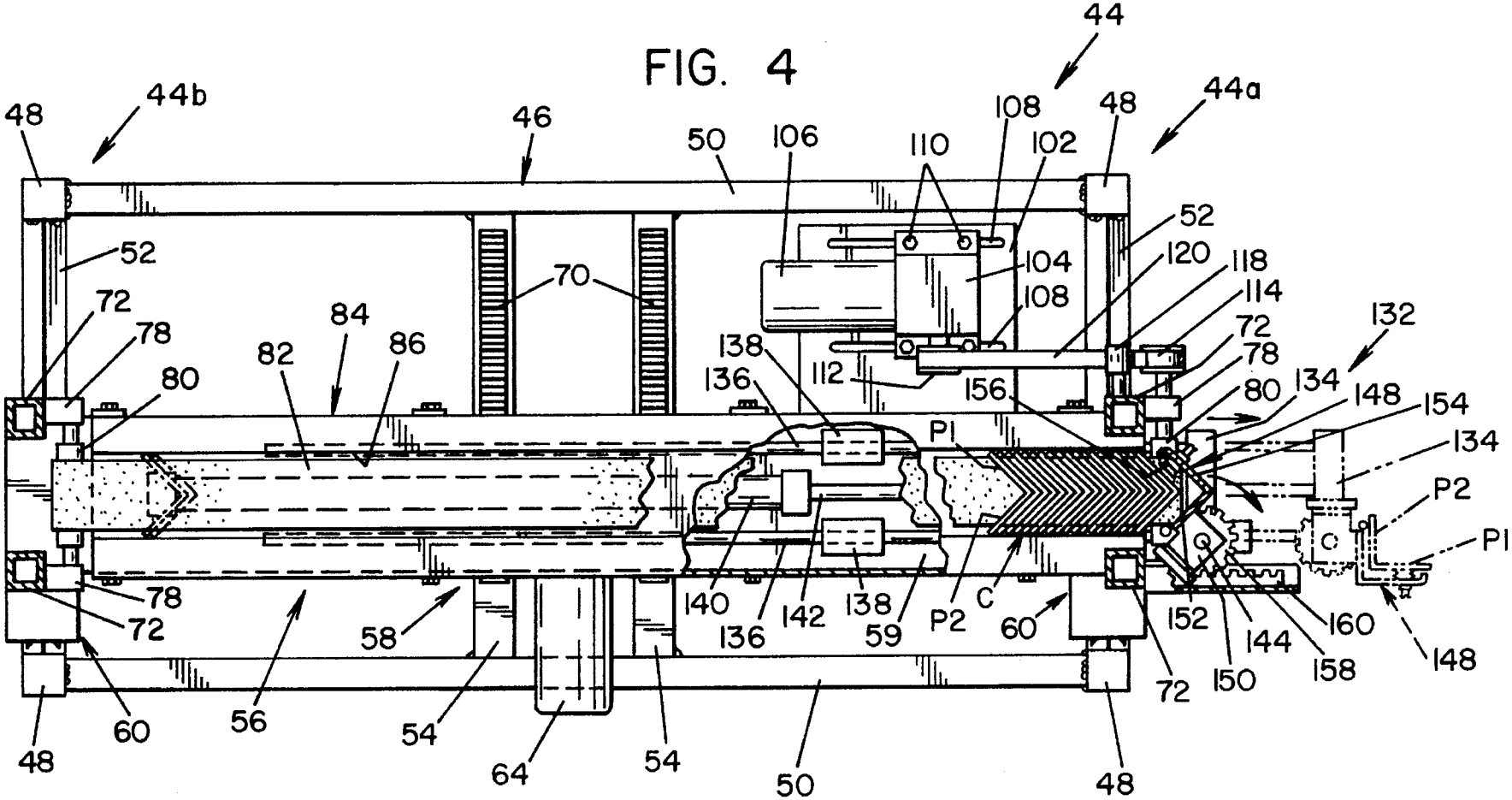
FIG. 4 is an view in section of the corner protector applying apparatus taken along line 4—4 in FIG. 3.
Figure 8:
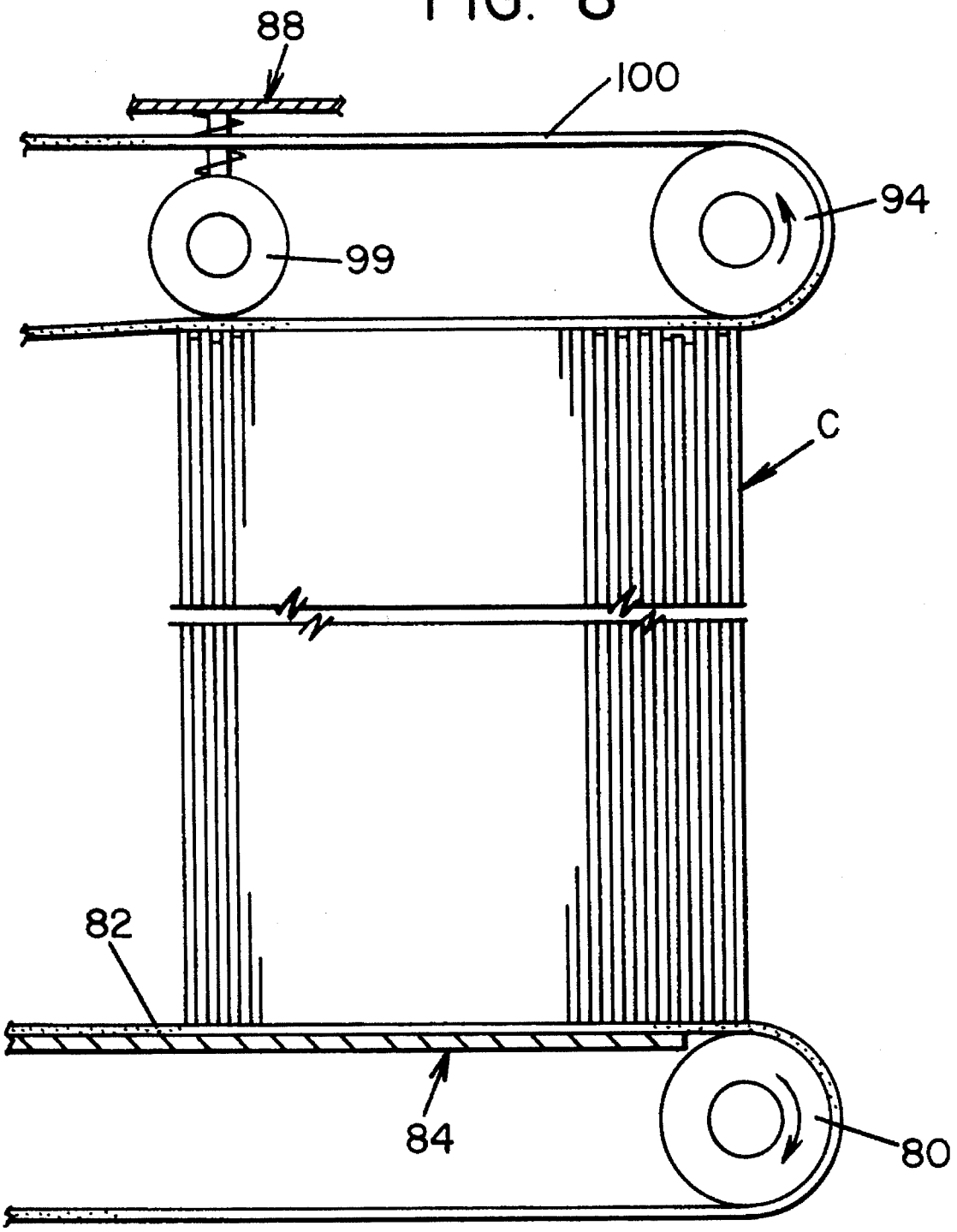
FIG. 8 is a detail side elevation view, somewhat schematic, showing a supply of corner protectors loaded between the conveyor belts.

As will be appreciated from the schematic illustration in FIG. 8, together with FIG. 4, a supply of corner protectors C are vertically disposed between the upper run of lower conveyor belt 82 and the lower run of upper conveyor belt 100 and are adapted to be advanced along a path from left to right in FIGS. 4 and 8 in response to driving of the belts to progressively move the corner protectors toward the discharge end of the magazine unit. With further regard to FIG. 8, it will be appreciated that the sagging characteristic of the lower run of upper conveyor belt 100 advantageously provides for the portion of the lower run behind the outermost one of the corner protectors in the magazine to deflect downwardly under its own weight and thus, in effect, converge relative to lower conveyor belt 82 to preclude the outermost corner protector or protectors from pivoting counterclockwise in FIG. 8 about the lower ends thereof. The sagging characteristic of the lower run of upper belt 100 further advantageously provides for the belt to conform to some extent to an uneven upper end profile of the corner protectors caused by varying lengths thereof and which lengths vary, as set forth hereinbefore, as a result of recycling of corner protectors, damage to the ends thereof during prior use, initial variations in length due to manufacturing errors, and the like. Further in connection with such displacement of corner protectors C toward the discharge end of the magazine, and as will be appreciated from FIG. 6, the laterally opposite sides of channel 86 are outwardly adjacent the laterally opposite edges of the upper run of lower conveyor belt 82, and the laterally opposite sides of channel 89 are outwardly adjacent the laterally opposite edges of the lower run of upper conveyor belt 100. Channels 86 and 89 receive the lower and upper ends of the corner protectors, respectively, and the sides thereof support the latter against lateral displacement relative to the corresponding belt. Preferably, the surfaces of belts 82 and 100 engaging the ends of the corner protectors are textured to enhance the frictional engagement thereof with the corner protectors. The pivotal mounting of upper conveyor 100 advantageously provides for the outer or input end of the conveyor to be pivoted upwardly as shown in FIG. 3 to facilitate loading the magazine unit with corner protectors.

In the embodiment disclosed herein, and as will be appreciated from FIG. 4, each of the corner protectors C is pre-bent to provide a pair of panels P1 and P2 meeting generally at a right angle to provide an inside corner therebetween. While not designated numerically, it will be appreciated that each of the panels P1 and P2 has a corresponding inner surface which facially overlies a side of load L when the corner protector is applied to a corner thereof, and that each of the panels P1 and P2 has a corresponding outer surface which, when loaded in the magazine, faces the inner or discharge end of the magazine. The forwardmost corner protector C in the magazine is restrained from unintentional displacement therefrom by a pair of spring finger units 128 each mounted on one of the upper corner post members 74 at the discharge end of the magazine and each of which includes a spring finger 130 engaging the outer surface of the corresponding one of the panels P1 and P2 of the forwardmost corner protector.

Each of the corner protector applying apparatus 44 further includes a pick-up and transfer arm unit 132 which is mounted on carriage plate member 59 for displacement with carriage assembly 58 laterally of frame assembly 46 and for longitudinal displacement relative to the carriage assembly. As best seen in FIGS. 4 and 5 of the drawing, arm assembly 132 includes a support 134 mounted on the ends of a pair of guide rods 136 which are supported for reciprocation relative to carriage assembly 58 by means of support blocks 138 mounted on carriage plate member 59. Support 134 is adapted to be reciprocated between the solid line and broken line position thereof shown in FIG. 4 by means of a piston and cylinder unit including a cylinder 140 mounted on carriage plate member 59 and a piston rod 142 reciprocable relative to the cylinder and having its outer end suitably fastened to support 134.

Pick-up and transfer arm assembly 132 further include an arm unit pivotal about a single vertical arm axis which is defined by a vertical arm shaft 144 rotatably supported in a sleeve 146 mounted on support member 134. A V-shaped pick-up plate 148 is mounted on the upper end of shaft 144 for rotation therewith by means of a mounting member 150. Pick-up plate 148 comprises a pair of panels 152 and 154 meeting generally at a right angle, and panel 152 is attached to mounting member 150. Panel 154 is provided on the inner side thereof with a plurality of vacuum pick-up heads 156 which are adapted to engage the outer surface of panel P1 of the innermost corner protectors C in the magazine to remove the corner protector therefrom as set forth more fully hereinafter. Shaft 144 is provided with a drive gear 158 for rotating the shaft and thus pick-up plate 148 about the arm axis, and a toothed rack 160 is secured to the inner end of corner post 72 and extends axially inwardly thereof in meshing engagement with gear 158. Gear 158 is adapted to be driven by rack 160 in response to displacement of support member 134 to the right in FIG. 4 from the solid line to the broken line position thereof and, during such displacement of support member 134 pick-up plate 148 is rotated about the arm axis 135° for the inner surfaces of corner protector panels P1 and P2 to be in the broken line position thereof shown in FIG. 4. This corresponds to the solid line position of the corner protector shown in FIG. 2 from which it will be appreciated that the inner surfaces of panels P1 and P2 are respectively parallel to sides 34 and 38 which meet to provide the corresponding corner of the load to which the corner protector is to be applied. When the corner protector is so positioned by the arm assembly, carriage assembly 58 is displaced laterally inwardly transverse to side 34 of the load, and arm assembly 132 is further displaced inwardly transverse to side 38 of the load. As will become apparent hereinafter, these displacements of the carriage and arm assembly bring the inner surfaces of corner protector panels P1 and P2 into facial engagement with sides 34 and 38 of the load at the corner therebetween. When the arm assembly is withdrawn from the broken line to the solid line position thereof shown in FIG. 4, gear 158 re-engages with rack 160 to rotate the pick-up plate 148 135° counterclockwise in FIG. 4 back to its initial position in which it is prepared to remove the innermost corner protector from the magazine in conjunction with the next displacement of support member 134 from the solid line to the broken line position shown in FIG. 4.

In accordance with another aspect of the invention, and as shown in FIGS. 1, 2, 9 and 10, wrapping apparatus 10 is provided with top protector applicator apparatus 162 comprising a shuttle mechanism 164 which supports a top protector pick-up, transfer and holding unit 166 for displacement between a top protector supply station 167 located laterally outwardly of stationary frame 12 and a position overlying load L in the film wrapping apparatus. Shuttle mechanism 164 includes a wheeled carriage unit 168 adapted to travel in opposite directions along a pair of carriage track rails 170 secured to the top of stationary frame assembly 12 of the wrapping apparatus and extending laterally outwardly thereof to overlie supply station 167. Carriage unit 168 includes a drive motor and gear box assembly 172 for driving the carriage unit along the rails. Pick-up, transfer and folding mechanism 166 is supported beneath carriage 168 for lateral displacement therewith and vertical displacement relative thereto and, for the latter purpose, carriage unit 168 includes a motor and gear box assembly 174 for vertically extending and retracting a support shaft 176 which carries pick-up, transfer and folding mechanism 166 at the lower end thereof. Relative to conveyor path P, pick-up, transfer and folding mechanism 166 includes a longitudinally opposite pair of folding finger assemblies 178 and 180 and a laterally opposite pair of folding finger assemblies 182 and 184 to be described in greater detail hereinafter. Supply station 167 includes a stationary frame comprising four corner posts 186 which support a vertically displaceable platform 188 adapted to support a stack of top protectors T and to maintain the uppermost one of the top protectors at a given elevation relative to pick-up, transfer and folding mechanism 166. As will become apparent hereinafter, the pick-up, transfer and folding mechanism is adapted to be lowered at supply station 167 to pick-up a top protector T, to elevate and transfer the top protector from the supply station to a position overlying load L at the wrapping station of the wrapping apparatus, to lower the top protector onto the top of load L, and to actuate the finger assemblies to fold marginal edge portions of the top protector downwardly across the top edges of the load and against the upper marginal edges of the sides of the load.

Figure 9:
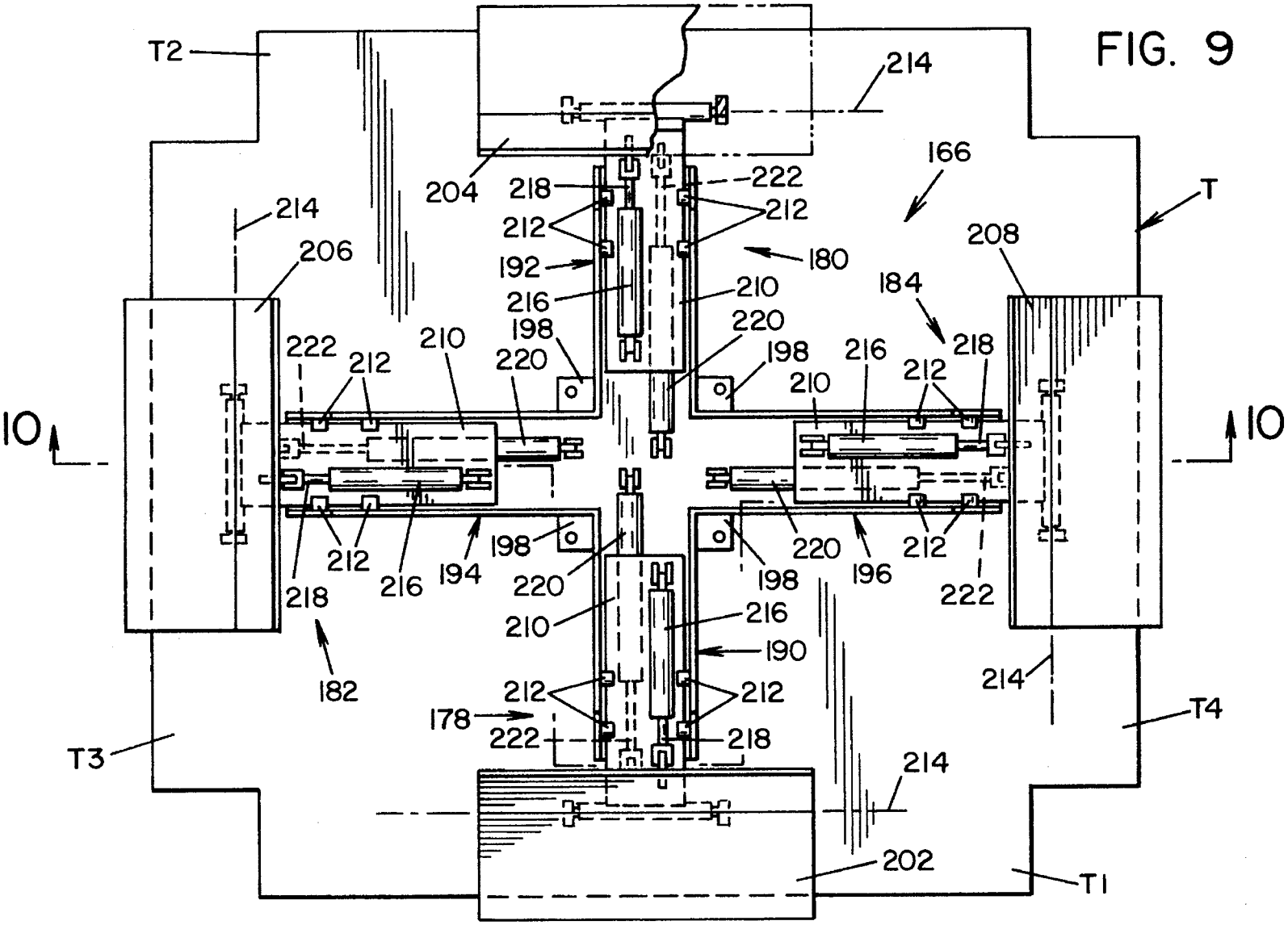
FIG. 9 is a plan view of the folding finger assembly of the top protector applying apparatus taken along line 9—9 in FIG. 1.
Figure 10:
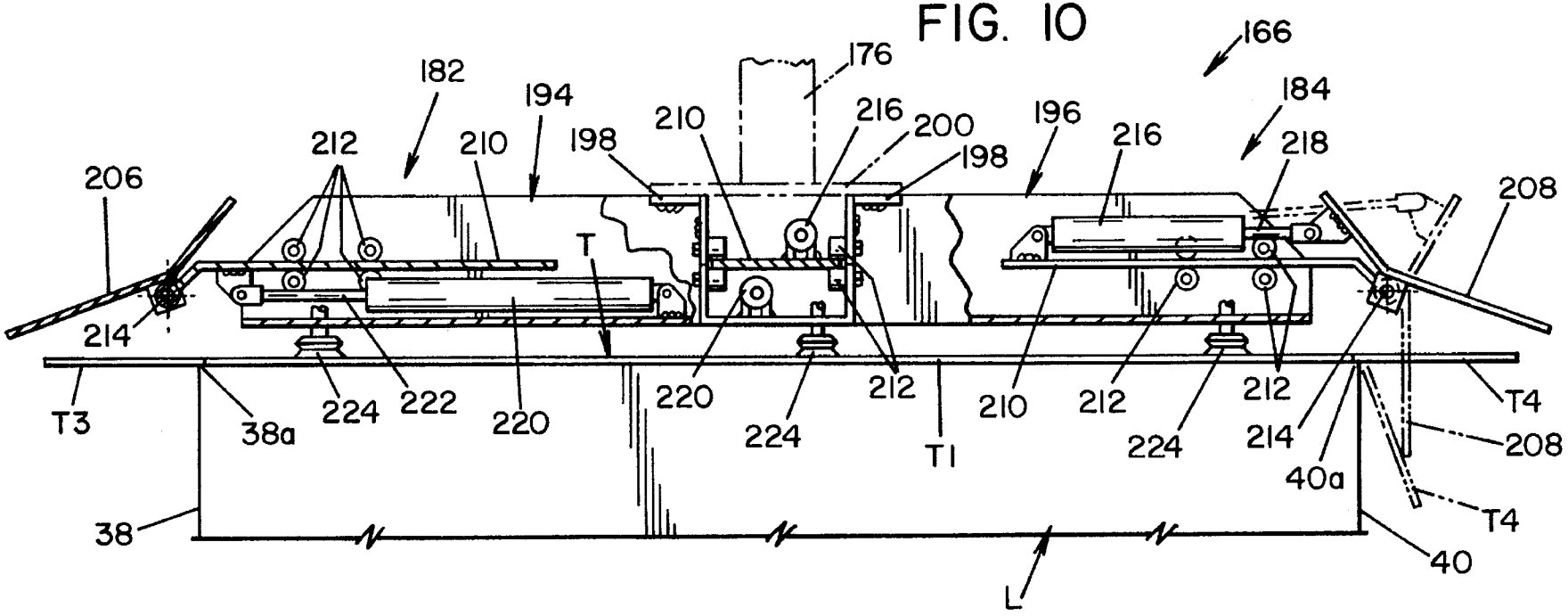
FIG. 10 is an elevation view, in section, of the folding finger assembly taken along line 10—10 in FIG. 9.

Referring now in particular to FIGS. 9 and 10 of the drawing, pick-up, transfer and folding mechanism 166 comprises a supporting frame for the folding finger assemblies and which frame includes longitudinally extending, upwardly open channel members 190 and 192 respectively supporting finger assemblies 178 and 180, and laterally extending upwardly open channel members 194 and 196 respectively supporting finger assemblies 182 and 184. The inner ends of the channel members are interconnected, such as by welding, and mounting plates 198 are secured to the corners between the inner ends of the channel members at the upper ends of the adjacent walls thereof, such as by welding, to facilitate attaching the supporting frame to a mounting plate 200 on the lower end of shaft 176.

Folding finger assemblies 178, 180, 182 and 184 include folding finger plates 202, 204, 206 and 208, respectively. Each of the finger plates is supported adjacent the outer end of the corresponding frame channel by a corresponding slide plate 210 which is supported in the frame channel for horizontal displacement outwardly and inwardly thereof by pairs of upper and lower rollers 212 mounted on the side walls of the channel and engaging the slide plate therebetween. Each finger plate is mounted on the outer end of the corresponding slide plate 210 for pivotal displacement about a corresponding finger axis 214 which, when the pick-up, transfer and folding mechanism 166 overlies load L, are each parallel to a corresponding top edge of the load. Each of the finger plates is pivotal about the corresponding finger axis 214 by a corresponding piston and cylinder unit including a cylinder member 216 having its inner end pivotally secured to slide plate 210 and having a piston rod 218 extending from the outer end thereof and pivotally secured to the corresponding finger plate such that displacement of piston rod 218 outwardly and inwardly relative to cylinder 216 pivots the finger plate in opposite directions about axis 214.

Each of the slide plates 210 is adapted to be horizontally reciprocated outwardly and inwardly of the corresponding frame channel by means of a corresponding piston and cylinder assembly including a cylinder member 220 having its inner end pivotally secured to the bottom wall of the frame channel and having a piston rod 222 extending from the outer end thereof and pivotally secured to the underside of slide plate 210. Accordingly, it will be appreciated that reciprocation of piston rod 222 in opposite directions relative to cylinder 220 horizontally displaces the corresponding finger plate and its pivot axis 214 outwardly and inwardly relative to the frame channel whereby, for the purpose set forth hereinafter, the distance between the pivot axes 214 of the opposed pairs of finger plates is adapted to be adjusted.

As will be appreciated from FIG. 10, the bottom wall of each of the channel members of the support frame of the pick-up, transfer and folding mechanism is provided with a vacuum cup device 224 by which a top protector T is adapted to be removed from supply station 167 and transferred by the mechanism to overlie top 42 of load L. As will be appreciated from FIGS. 9 and 10, top protector T has notched corners which provide the top_protector, relative to path P, with longitudinally opposite marginal edge portions T1 and T2 and laterally opposite marginal edge portions T3 and T4. When the top protector overlies top 42 of load T, marginal edge portions T1–T4 respectively extend outwardly from longitudinally opposite top edges 34*a* and 36*a* and laterally opposite top edges 38*a* and 40*a* of the load. The notched corners of the top protector provide the marginal edge portions thereof with imaginary fold lines which are adjacent the corresponding top edge of load L whereby, upon actuation of the finger plates to pivot the latter downwardly about the corresponding finger axis, the underlying marginal edge portion of the top protector is folded downwardly along the imaginary fold line and about the corresponding load top edge.

In accordance with the present invention, such folding of the marginal edge portions of the top protector can be performed in connection with top protectors for loads having different top edge dimensions and thus different distances between the parallel opposite edges of the top. This will be appreciated from the illustration of the folding sequence in connection with finger plate 208 in FIG. 10, and finger plates 206 and 208 in FIGS. 12A–12C. In these Figures it will be seen that the finger axes 214 of the plates are laterally outwardly of the corresponding one of top edges 38*a* and 40*a*, whereby pivotal displacement of the finger plates about axes 214 to the vertical position of the finger plates shown in FIG. 12B provides for folding marginal edge portions T3 and T4 of the top protector downwardly about top edges 38*a* and 40*a* to a position in which the marginal edge portions are angled relative to sides 38 and 40 of the load, respectively. Completion of the application of top protector T is then achieved by displacing slide plates 210 laterally inwardly so that finger plates 106 and 108 move marginal edge portions T3 and T4 into facial engagement with sides 38 and 40 of the load, as shown in FIG. 12C. Thus, it will be appreciated that the folding finger assembly is operable to apply top protectors to loads in which the distance between opposed parallel edges of the load varies between a minimum and maximum corresponding to the distance between axes 214 in the innermost and outermost positions thereof relative to one another.

Figure 11A:
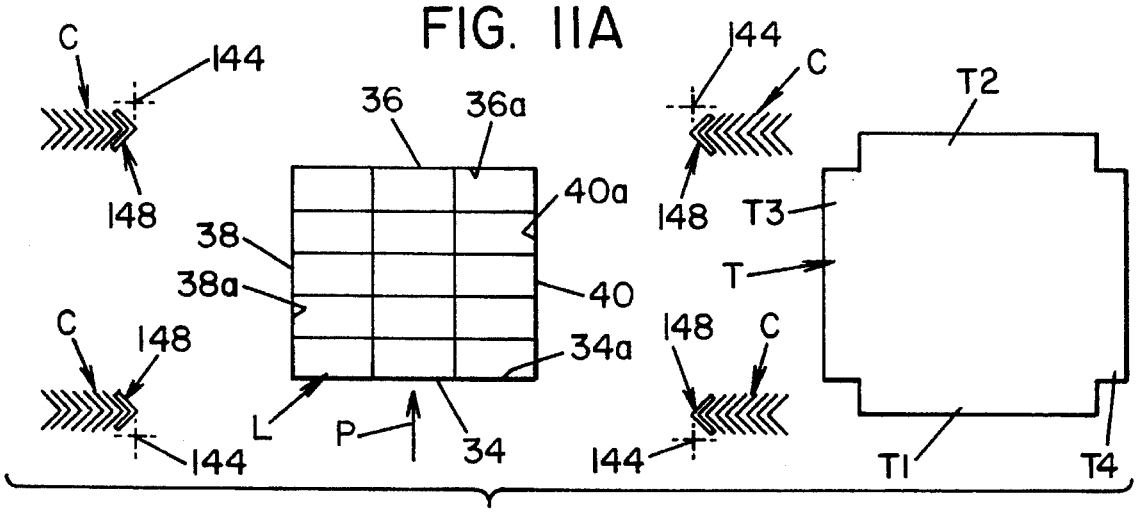

It is believed that the operation of the corner protector applying apparatus and the top protector applying apparatus in conjunction with the film wrapping of load L will be understood from the foregoing description of the structure and operation of the latter apparatus in conjunction with the following description of FIGS. 11A–11G which schematically illustrate the sequence of operations of the apparatus in applying the corner protectors and top protector to a load which is then wrapped in plastic film. More particularly in this respect, FIG. 11A illustrates the components in the positions thereof prior to initiating operation of the apparatus. In these positions, the four magazines support the corresponding supply of corner protectors C with the outer sides thereof facing the corresponding corner of load L, and the carriage assemblies which support the magazines are positioned longitudinally outwardly of the corresponding one of the sides 34 and 36 of the load. The supply of top protectors T is positioned laterally outwardly from side 40 of load L. When a wrapping operation is initiated, each of the pick-up plates 148 removes the innermost corner protector from the corresponding magazine by pivoting the corresponding arm assembly 135° about arm axis 144 in the directions shown in FIG. 11B. Such angular displacement of pick-up plates 148 positions the corresponding corner protector with the inner sides of panels P1 and P2 thereof respectively parallel to the sides of load L forming the corresponding corner. Further, in this position of the corner protectors, the planes of panels P1 are longitudinally spaced outwardly from the corresponding one of the longitudinally opposite sides 34 and 36 of the load, and the planes of panels P2 are spaced laterally outwardly from the corresponding one of the laterally opposite sides 38 and 40 of the load.

Figure 11B:
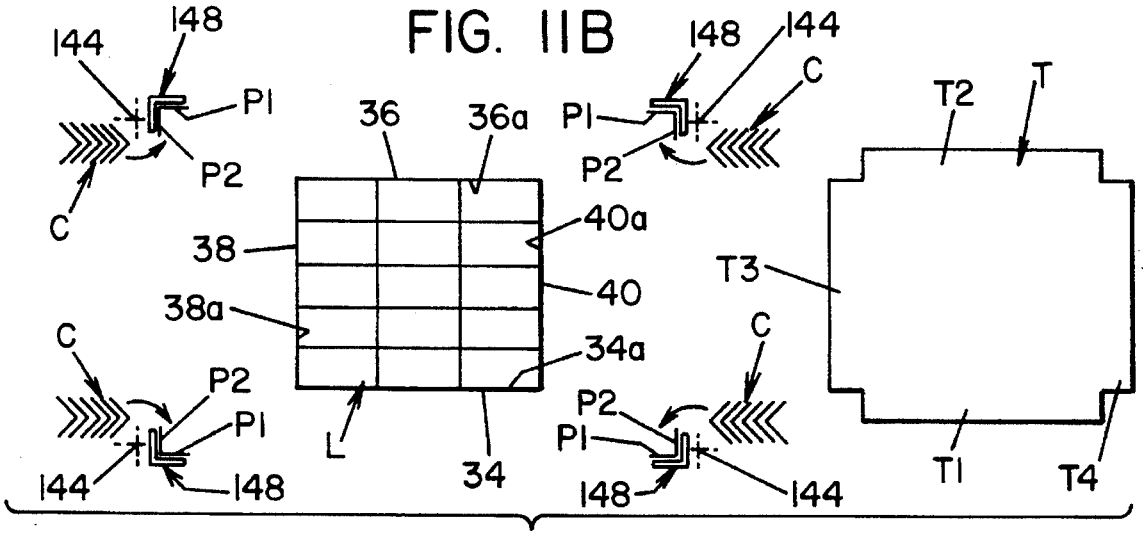
Figure 11C:
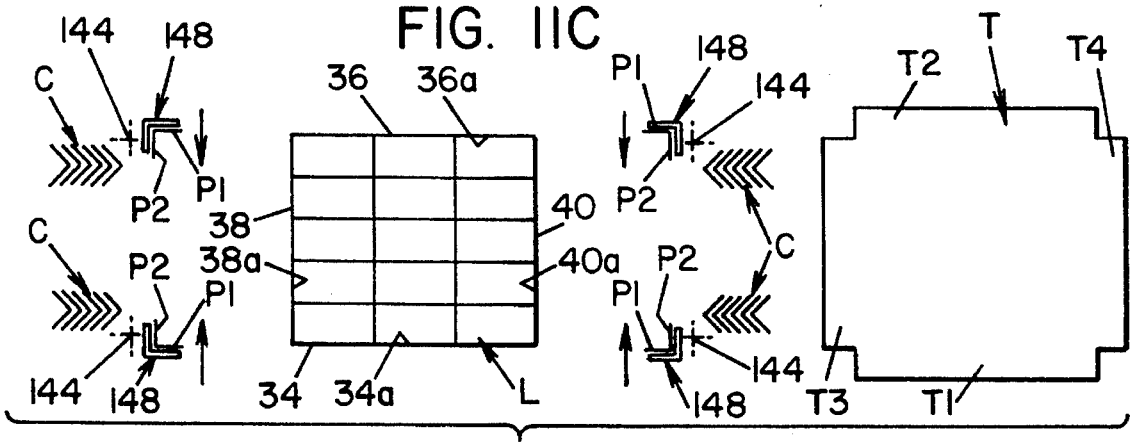

Following rotation of the pick-up plates 148 to the positions shown in FIG. 11B, the carriages on which the magazines and arm assemblies are mounted are displaced longitudinally inwardly relative to load L as indicated by the arrows in FIG. 11C and to the positions shown in the latter Figure. In these positions, the inner surfaces of panels P1 are respectively longitudinally aligned with the corresponding one of the longitudinally opposite sides 34 and 36 of load L. Thereafter, or in conjunction with such displacement of the carriages, the arm assemblies are displaced laterally inwardly relative to the corresponding carriage as indicated by the arrows adjacent load L in FIG. 11D. This displacement of the arm assemblies positions the inner sides of corner protector panels P1 in overlying relationship with respect to the corresponding one of the longitudinally opposite sides 34 and 36 of the load and moves the inner sides of panels P2 into overlying relationship with the corresponding one of the laterally opposite sides 38 and 40 of the load.

Figure 11D:
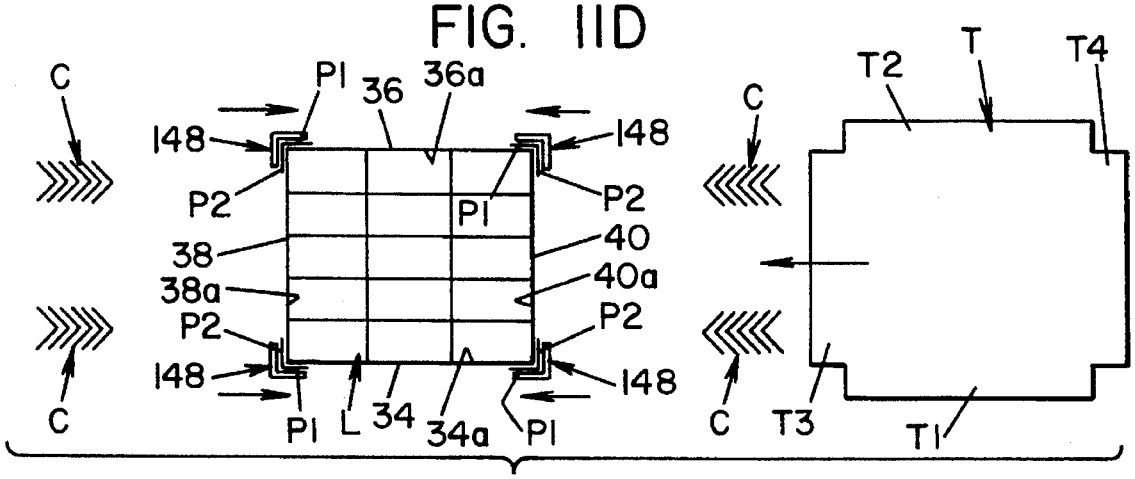
Figure 11E:
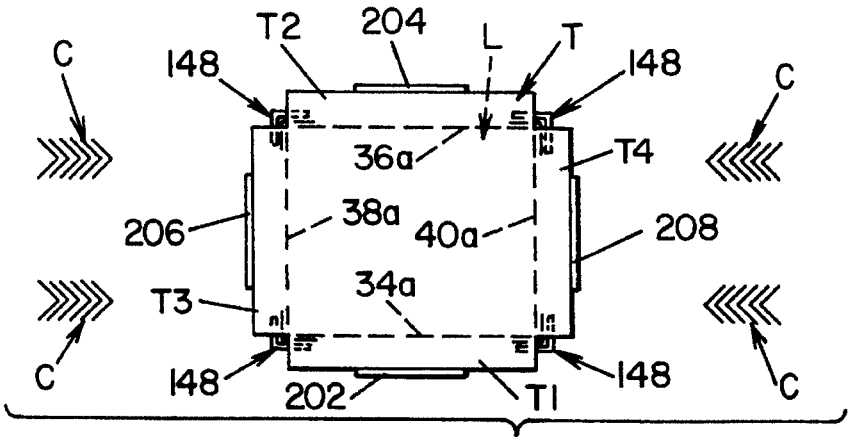

The arm assemblies and thus pick-up plates 148 remain in the positions thereof shown in FIG. 11D and, while so positioned, the top protector pick-up, transfer and folding assembly displaces a top protector T laterally inwardly of load L from the top protector supply station to a position in which the top protector overlies the top of load L as shown in FIG. 11E. When the top protector is so positioned, and while pick-up plates 148 hold the corresponding corner protectors in place at the corners of the load, finger plates 202, 204, 206 and 208 are simultaneously actuated as described above in conjunction with FIGS. 12A–12C to fold marginal edge portions T1, T2, T3 and T4 of the top protector downwardly about top edges 34*a*, 36*a*, 38*a* and 40*a* of the load to position the marginal edge portions of the top protector against the corresponding side of the load as shown in FIG. 11F.

Figure 11F:
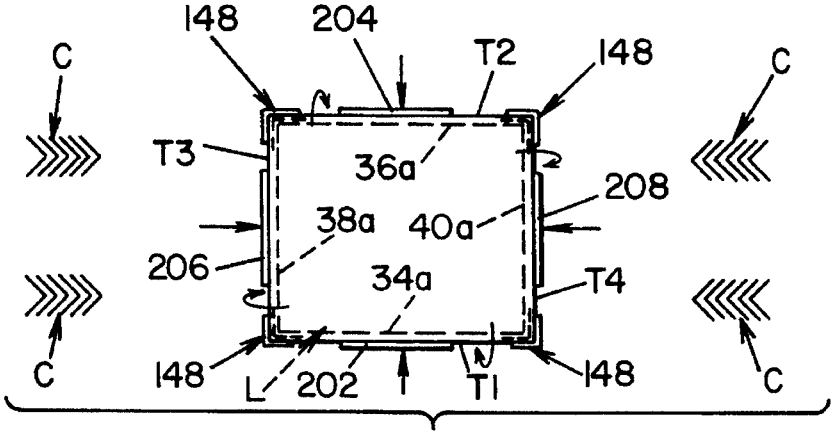

While the pick-up plates 148 and finger plates are in the positions shown in FIG. 11F, the wrapping apparatus is activated whereupon ring 16 rotates about load L to wrap film F thereabout beginning at the upper end of the load so as to initially capture the downwardly extending marginal edge portions of top protector T and the upper ends of corner protectors C, as will be appreciated from FIG. 11G. When the marginal edge portions of the top protector and the upper ends of the corner protectors are so captured, and while the wrapping operation continues, the top protector pick-up, transfer and folding assembly is elevated relative to the top of the load to withdraw the folding fingers from beneath the plastic wrap, the arm assemblies are laterally withdrawn relative to the corresponding carriage, and the carriages are longitudinally displaced in opposite directions back towards their initial positions. These displacements of the arm assemblies and carriages is indicated by arrows 226 in FIG. 11G. As will be appreciated from the description above regarding the movement of the arm assemblies to engage the corner protectors with the corners of the load, the arm assemblies can be retracted relative to the corresponding carriage assembly either before or in conjunction with the longitudinal displacement of the carriage back to its initial position. Further, as will be appreciated from the description of the arm assembly in conjunction with FIG. 4 of the drawing, retraction of the arm assembly relative to the corresponding carriage engages pinion 158 and rack 160 so as to pivot pick-up plate 148 in the direction shown in FIG. 11G back to its initial position for picking-up the innermost corner protector from the magazine during subsequent operation of the apparatus.

Preferably, as will be appreciated from FIG. 8, a plurality of spring biased idler rollers 99 are positioned between the upper and lower runs of upper conveyor belt 100 and between conveyor rolls 94 and 98 to enhance contact between the lower run of the belt and the upper ends of corner protectors C.

While considerable emphasis has been placed herein on the structures and structural interrelationships between the component parts of the preferred embodiments of the invention, it will be appreciated that many embodiments of the invention can be devised and many changes made in the preferred embodiments without departing from the principles of the invention. Accordingly, it is to be distinctly understood that the foregoing descriptive matter is to be interpreted merely as illustrative of the invention and not as a limitation.

Having thus described the invention it is claimed:

1. In apparatus for placing a corner protector onto a corner of a load, which corner protector has first and second opposite ends and an inside surface therebetween and which apparatus includes supply means for holding a plurality of said corner protectors and means for removing a corner protector from said supply means and for transferring said removed corner protector from said supply means to a position in which the inside surface thereof faces said corner of said load, the improvement comprising: said supply means having input and exit ends and including drivable means for engaging said first and said second opposite ends of said plurality of corner protectors and moving said plurality of corner protectors along a path in the direction from said input end toward said exit end of said supply means.

2. The improvement according to claim 1, wherein said drivable means includes first and second conveyor means spaced apart for respectively engaging said first and said second opposite ends of said plurality of corner protectors.

3. The improvement according to claim 1, wherein said supply means includes means for confining said plurality of corner protectors against displacement laterally of said path.

4. The improvement according to claim 1, wherein said drivable means is adjustable in the direction between said first and said second opposite ends of said corner protectors.

5. The improvement according to claim 1, wherein said first and second opposite ends of said corner protectors are upper and lower ends and said drivable means includes first conveyor means underlying said lower ends and second conveyor means overlying said upper ends.

6. The improvement according to claim 5, wherein at least said second conveyor means includes flexible belt means.

7. The improvement according to claim 5, wherein said second conveyor means is vertically adjustable relative to said first conveyor means.

8. The improvement according to claim 5, wherein each said first and second conveyor means have input and exit ends respectively at said input and exit ends of said supply means, and means supporting said second conveyor means for pivotal movement toward and away from said first conveyor means about a horizontal axis at said exit end of said second conveyor means.

9. The improvement according to claim 8, and means for limiting pivotal movement of said second conveyor means toward said first conveyor means.

10. The improvement according to claim 1, wherein said drivable means includes first and second conveyor means spaced apart for respectively engaging said first and second opposite ends of said plurality of corner protectors, and common drive means for driving said first and second conveyor means in unison.

11. The improvement according to claim 10, wherein said first and second conveyor means respectively include first and second endless conveyor belt means and said common drive means includes drive motor means and drive belt means between said motor means and each said first and second conveyor belt means to drive said conveyor belt means in unison.

12. The improvement according to claim 11, wherein said drive motor means and said drive belt means are adjustable to accommodate varying the space between said first and second conveyor belt means.

13. The improvement according to claim 5, wherein said first and second conveyor means respectively include first and second conveyor belt means.

14. The improvement according to claim 13, wherein said second conveyor means is vertically adjustable relative to said first conveyor means.

15. The improvement according to claim 13, wherein each said first and second conveyor belt means has laterally opposite edges extending in the direction between said input and exit ends of said supply means, and guide means laterally outwardly adjacent said edges for confining said corner protectors against displacement laterally of said first and second conveyor belt means.

16. The improvement according to claim 13, wherein each said first and second conveyor belt means has input and exit ends respectively at said input and exit ends of said supply means, and means supporting said second conveyor belt means for pivotal movement toward and away from said first conveyor belt means about a horizontal axis at said exit end of said second conveyor belt means.

17. The improvement according to claim 16, wherein said second conveyor belt means is vertically adjustable relative to said first conveyor belt means.

18. The improvement according to claim 13, wherein said second conveyor belt means is vertically adjustable relative to said first conveyor belt means, and common drive means for driving said first and second conveyor belt means in unison.

19. The improvement according to claim 18, wherein said common drive means includes drive motor means and drive belt between said motor means and each said first and second conveyor belt means.

20. The improvement according to claim 19, wherein said drive motor means and said drive belt means are adjustable to accommodate varying the space between said first and second conveyor belt means.

21. The improvement according to claim 20, wherein each said first and second conveyor belt means has input and exit ends respectively at said input and exit ends of said supply means, and means supporting said second conveyor belt means for pivotal movement toward and away from said first conveyor belt means about a horizontal axis at said exit end of said second belt means.

22. The improvement according to claim 21, wherein each said first and second conveyor belt means has laterally opposite edges extending in the direction between said input and exit ends of said supply means, and guide means laterally outwardly adjacent said edges for confining said corner protectors against displacement laterally of said first and second conveyor belt means.

23. Apparatus for wrapping a load in film material comprising, frame means having opposite sides and opposite ends and providing a wrapping station for a load having vertical sides intersecting at an angle to provide said load with four vertical corners, said wrapping station having inlet and outlet ends along a path between said opposite ends, means including film carriage means supported on said frame means for rotation about a vertical axis for wrapping film material about said vertical sides of said load, and a corner protector supply and applicator assembly for each corner of said load comprising corner protector magazine means for holding a supply of corner protectors, said magazine means extending transverse to said path and having outer and inner ends, said inner end being closer to said path than said outer end, said corner protectors having top and bottom ends and inner and outer surfaces between said top and bottom ends, said magazine means including top and bottom conveyor means respectively engaging said top and bottom ends of said corner protectors therebetween, means to drive said top and bottom conveyor means for moving said corner protectors toward said inner end of said magazine means, and means including applicator means adjacent said inner end of said magazine means for removing a corner protector therefrom and transferring said removed corner protector to the corresponding corner of said load for said inner surface of said corner protector to face said corresponding corner of said load.

24. Apparatus according to claim 23, and means supporting said supply and applicator assembly for horizontal displacement perpendicular to and parallel to said path.

25. Apparatus according to claim 24, wherein said means supporting said supply and applicator means includes carriage means supporting said magazine means and said applicator means, and means for displacing said carriage means perpendicular to said path.

26. Apparatus according to claim 25, and means mounting said applicator means on said carriage means for displacement relative thereto perpendicular to said path.

27. Apparatus according to claim 23, wherein said inner surfaces of said corner protectors are defined by first and second panels meeting at an angle generally equal to the angle of the corresponding corners of said load, said corner protectors being supported between said top and bottom conveyor means with said outer surfaces facing said inner end of said magazine means, and said applicator means including arm means pivotal about a single arm axis between first and second positions in which said arm means is respectively positioned to remove a corner protector from said inner end of said magazine means and to hold the removed corner protector with said first and second panels parallel to the sides of said load intersecting to provide the corresponding corner of said load.

28. Apparatus according to claim 27, and means for displacing said applicator means perpendicular to and parallel to said path.

29. Apparatus according to claim 27, wherein said first and second positions of said arm means are angularly spaced apart about 135° with respect to said arm axis.

30. Apparatus according to claim 23, wherein each said top and bottom conveyor means includes endless belt means, and said means to drive said conveyor means includes common drive means for said belt means of said top and bottom conveyor means.

31. Apparatus according to claim 23, wherein said load has a top and top edges between said corners, and top cap applicator means for applying a top cap onto the top of said load, said top cap having marginal edge portions extending outwardly from said top edges, and said top cap applicator means including finger means corresponding to each of said top edges, each of said finger means being pivotal about a finger axis parallel to the corresponding top edge, and each of said finger means being simultaneously horizontally reciprocable transverse to said finger axis.

32. Apparatus according to claim 31, wherein said top cap applicator means includes shuttle means and means supporting said shuttle means for displacement between first and second positions in which said shuttle means is respectively laterally outwardly of one of said opposite sides of said frame means and overlying a load at said wrapping station, said shuttle means carrying said finger means, and means to displace said shuttle means between said first and second positions thereof.

33. Apparatus according to claim 32, wherein said shuttle means includes top cap pick-up means, top cap supply means laterally outwardly of said one side of said frame means, said pick-up means in said first position of said shuttle means being positioned to remove a top cap from said top cap supply means, and said pick-up means in said second position of said shuttle means being positioned to place said top cap on said top of said load.

34. Apparatus according to claim 23, further including carriage means and means supporting said carriage means for horizontal displacement parallel to said path, said magazine means and said applicator means being mounted on said carriage means for movement therewith, and said applicator means being mounted on said carriage means for horizontal movement relative thereto parallel to said path.

35. Apparatus according to claim 34, wherein each said top and bottom conveyor means includes endless belt means, and said means to drive said conveyor means includes common drive means for said belt means of said top and bottom conveyor means.

36. Apparatus according to claim 35, wherein said inner surfaces of said corner protectors are defined by first and second panels meeting at an angle generally equal to the angle of the corresponding corner of said load, said corner protectors being supported between said top and bottom conveyor means with said outer surfaces facing said inner end of said magazine means, and said applicator means including arm means pivotal about a single arm axis between first and second positions in which said arm means is respectively positioned to remove a corner protector from said inner end of said magazine means and to hold the removed corner protector with said first and second panels parallel to the sides of said load intersecting to provide the corresponding corner of said load.

37. Apparatus according to claim 35, wherein said load has a top and top edges between said corners, and top cap applicator means for applying a top cap onto the top of said load, said top cap having marginal edge portions extending outwardly from said top edges, and said top cap applicator means including finger means corresponding to each of said top edges, each of said finger means being pivotal about a finger axis parallel to the corresponding top edge and horizontally reciprocable transverse to said finger axis.

38. Apparatus according to claim 37, wherein said inner surfaces of said corner protectors are defined by first and second panels meeting at an angle generally equal to the angle of the corresponding corner of said load, said corner protectors being supported between said top and bottom conveyor means with said outer surfaces facing said inner end of said magazine means, and said applicator means including arm means pivotal about a single arm axis between first and second positions in which said arm means is respectively positioned to remove a corner protector from said inner end of said magazine means and to hold the removed corner protector with said first and second panels parallel to the sides of said load intersecting to provide the corresponding corner of said load.

39. Apparatus according to claim 38, wherein said top cap applicator means includes shuttle means and means supporting said shuttle means for displacement between first and second positions in which said shuttle means is respectively laterally outwardly of one of said opposite sides of said frame means and overlying a load at said wrapping station, said shuttle means carrying said finger means, and means to displace said shuttle means between said first and second positions thereof.

40. Apparatus according to claim 39, wherein said shuttle means includes top cap pick-up means, top cap supply means laterally outwardly of said one side of said frame means, said pick-up means in said first position of said shuttle means being positioned to remove a top cap from said top cap supply means, and said pick-up means in said second position of said shuttle means being positioned to place said top cap on said top of said load.

* * * * *